US006892662B2

(12) United States Patent
Watanabe et al.

(10) Patent No.: US 6,892,662 B2
(45) Date of Patent: May 17, 2005

(54) POWER STEERING DEVICE FOR BOAT WITH OUTBOARD MOTOR

(75) Inventors: Kouichi Watanabe, Tokyo (JP); Koichiro Awano, Tokyo (JP); Takashi Okumura, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 0 days.

(21) Appl. No.: 10/702,560

(22) Filed: Nov. 7, 2003

(65) Prior Publication Data

US 2004/0173135 A1 Sep. 9, 2004

(30) Foreign Application Priority Data

Mar. 3, 2003 (JP) ..... 2003-055673

(51) Int. Cl.[7] ..... B63H 25/00

(52) U.S. Cl. ..... 114/144 R; 440/58; 440/62; 440/63

(58) Field of Search ..... 440/53–63; 114/144 R, 114/154–159, 144 RE

(56) References Cited

U.S. PATENT DOCUMENTS 4,573,545 A * 3/1986 Kalns ..... 180/404
5,603,279 A * 2/1997 Hundertmark et al. ..... 114/150

FOREIGN PATENT DOCUMENTS

JP 2652788 5/1997

* cited by examiner

*Primary Examiner*—Ed Swinehart
(74) *Attorney, Agent, or Firm*—Rabin & Berdo P.C.

(57) ABSTRACT

To provide a power steering device for a boat with an outboard motor which helps to realize easy drive with small steering force without taking waterproofness into consideration. A gear device (4) is provided for driving a link mechanism for turning and steering an outboard motor main body at the rear of the boat body through a cable by a steering wheel (2). A steering torque input to the gear device (4) by the steering wheel (2) is detected by a torque sensor (35) to assist-drive the gear device 4 in the steering direction by an electric motor (27), a helical pinion (25), and a helical wheel (26).

3 Claims, 12 Drawing Sheets

POWER STEERING DEVICE FOR BOAT WITH OUTBOARD MOTOR

FIELD OF THE INVENTION

The present invention relates to a power steering device for a boat in which the steering of an outboard motor with an engine mounted therein is power-assisted.

BACKGROUND OF THE INVENTION

JP 2652788 B proposes a conventional power steering device for a boat with an outboard motor in which power-assisting is effected by an electric motor.

In the above-mentioned conventional device, the operation of the steering wheel arranged at the driver's seat is transmitted through a wire to an outboard motor with an engine steerably supported at the rear of the boat, and the outboard device is rotated in correspondence with the steering amount of the steering wheel. Further, there is provided a power assist mechanism by means of which the torque of an electric motor causes the outboard motor to rotate through a speed reduction gear. An electronic control unit (ECU) controls the assisting force of the electric motor in correspondence with a steering torque signal of a torque sensor for sensing steering torque from a steering force acting on the wire portion, an engine RPM signal of the outboard motor, etc.

However, in the above-described conventional device, in which the electric motor and the torque sensor are arranged in the vicinity of the engine of the outboard motor, it is necessary to achieve an improvement in waterproofness so as to prevent intrusion of water scattered from the propeller, etc., resulting in an increase in product cost.

Further, due to the use of the steering torque sensor for sensing the operating force of the wire through which the outboard motor is pushed and pulled by operating the steering wheel, the steering torque that can be sensed is reduced due to friction of the wire generated in steering, with the result that the assisting force is suppressed, which leads to a limitation to a reduction in the requisite steering force.

The present invention has been made in view of the above problems in the prior art. It is an object of the present invention to provide a power steering device for a boat in which there is no need to take waterproofness into consideration and which allows easy drive with small steering force.

SUMMARY OF THE INVENTION

In order to achieve above object, this invention provides a power steering device for a boat equipped with an outboard motor arranged at a rear of a boat body so as to be horizontally swingable, comprising: a link mechanism for swinging an outboard motor main body at the rear of the boat body; a gear device operated by a steering wheel; a connection mechanism for transmitting an output of the gear device to the link mechanism; a torque detecting device for detecting a steering torque input to the gear device from the steering wheel; a gear drive device for assist-driving the gear device in a steering direction according to at least a detection signal of the torque detecting device; and a control device adapted to take in the detection signal of the torque sensor and to perform computation on the detection signal to drive the gear drive device.

DESCRIPTION OF THE PREFERRED EMBODIMENTS

An embodiment of the present invention will now be described with reference to the accompanying drawings.

Figure 1:
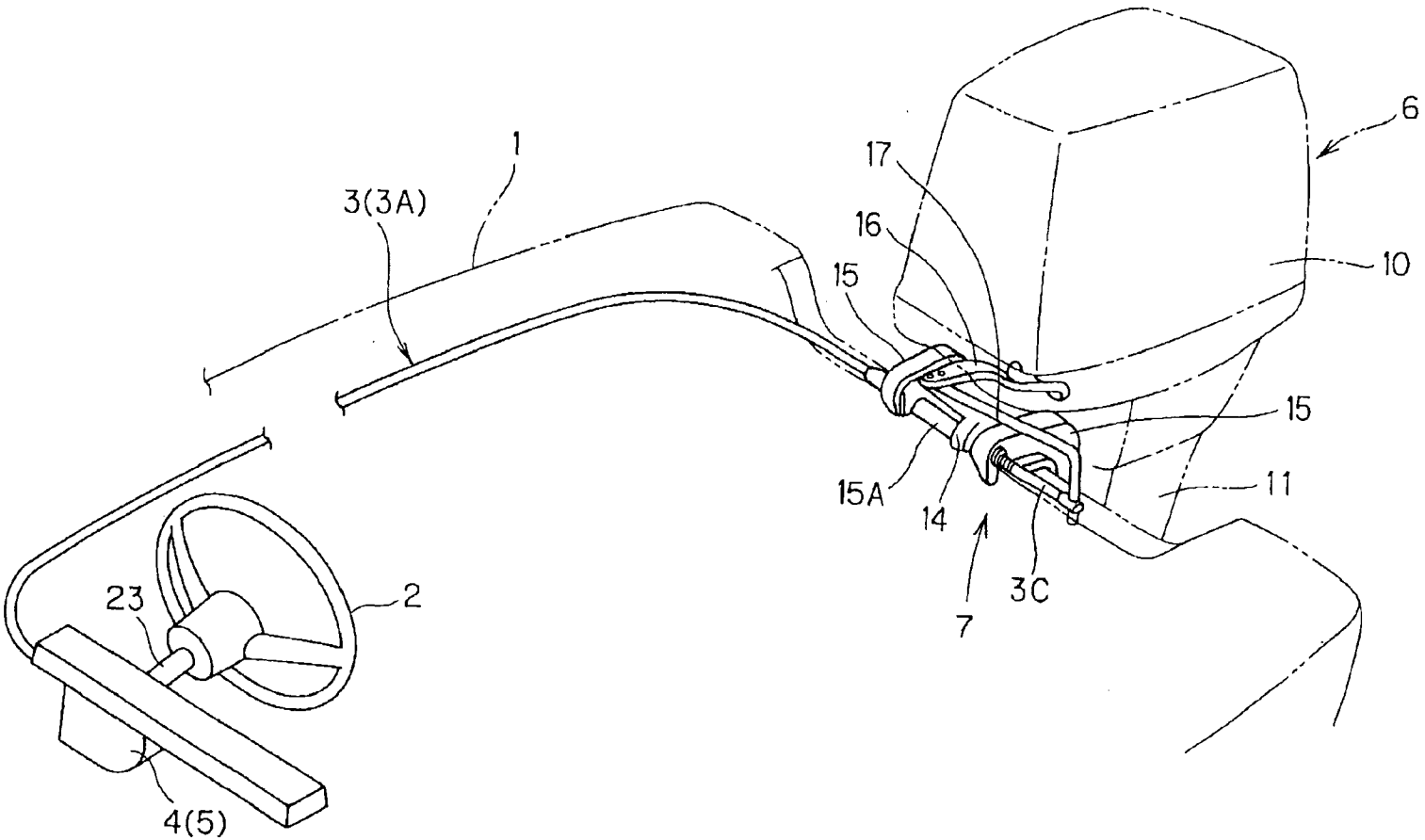
FIG. 1 is a perspective view of a power steering device for a boat according to a first embodiment of the present invention.

FIG. 1 is a perspective view of a power steering device for a boat with an outboard motor to which the present invention is applied. The power steering device is composed of a gear device 4 and a power assist device 5 which are installed at the driver's seat of a boat body 1 and adapted to convert the operation of a steering wheel 2 into a push-pull action of cable 3, and a link mechanism 7 arranged at the rear of the boat body 1 and to which an outboard motor 6 is mounted, the link mechanism 7 being adapted to swing the outboard motor 6 in correspondence with the push-pull action of the cable 3.

Figure 2:
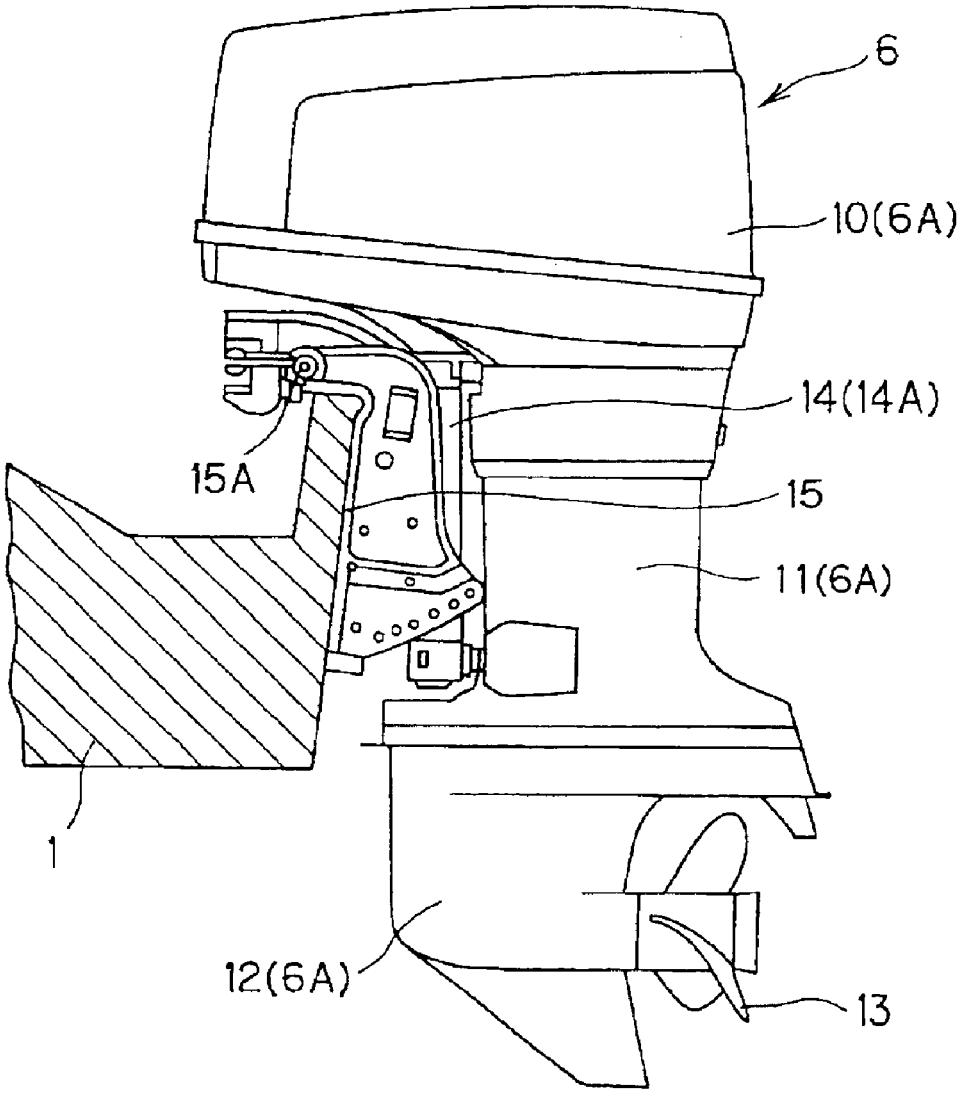
FIG. 2 is a side view of an outboard motor.

As shown in FIG. 2, the outboard motor 6 is equipped with an outboard motor main body 6A constructed such that the rotation of an engine inside an engine housing 10 is transmitted to a propeller 13 through a drive shaft in a drive shaft housing 11 and a bevel gear in a gear housing 12. Through rotation of the propeller 13 of the outboard motor main body 6A, the driving force for the boat is generated. The outboard motor main body 6A is supported so as to be swingable in a horizontal plane by a pilot shaft 14A, which is a vertical shaft provided on a bracket 14. The bracket 14 is supported by a clamp bracket 15 through the intermediation of a clamp bracket shaft 15A, which is a horizontal shaft. The clamp bracket 15 is fixed to the transom of the boat body 1. Thus, the bracket 14 and the outboard motor main body 6A can be lifted counterclockwise as seen in the side view of the boat.

Figure 3:
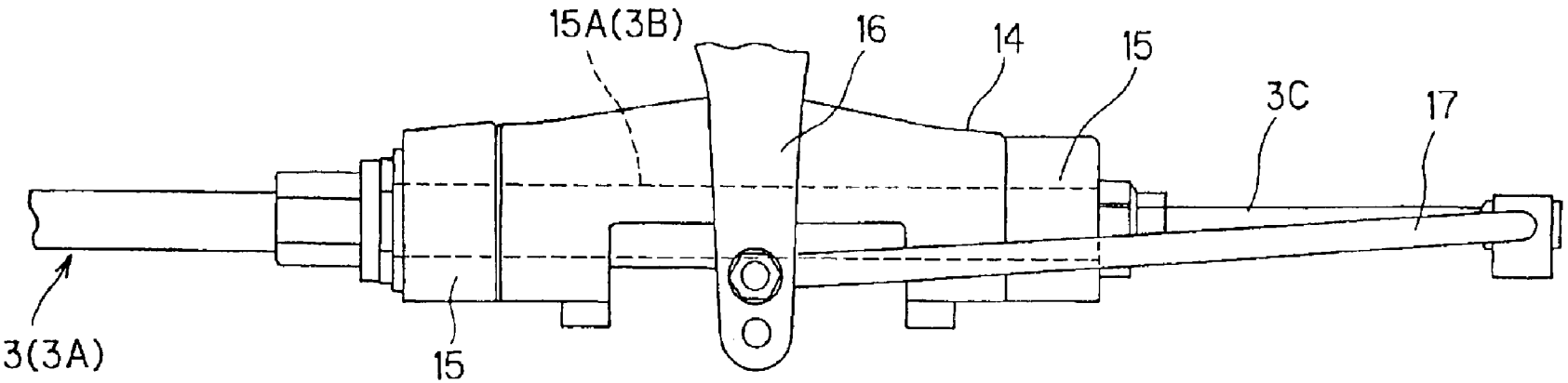
FIG. 3 is a plan view of a link mechanism.
Figure 4:
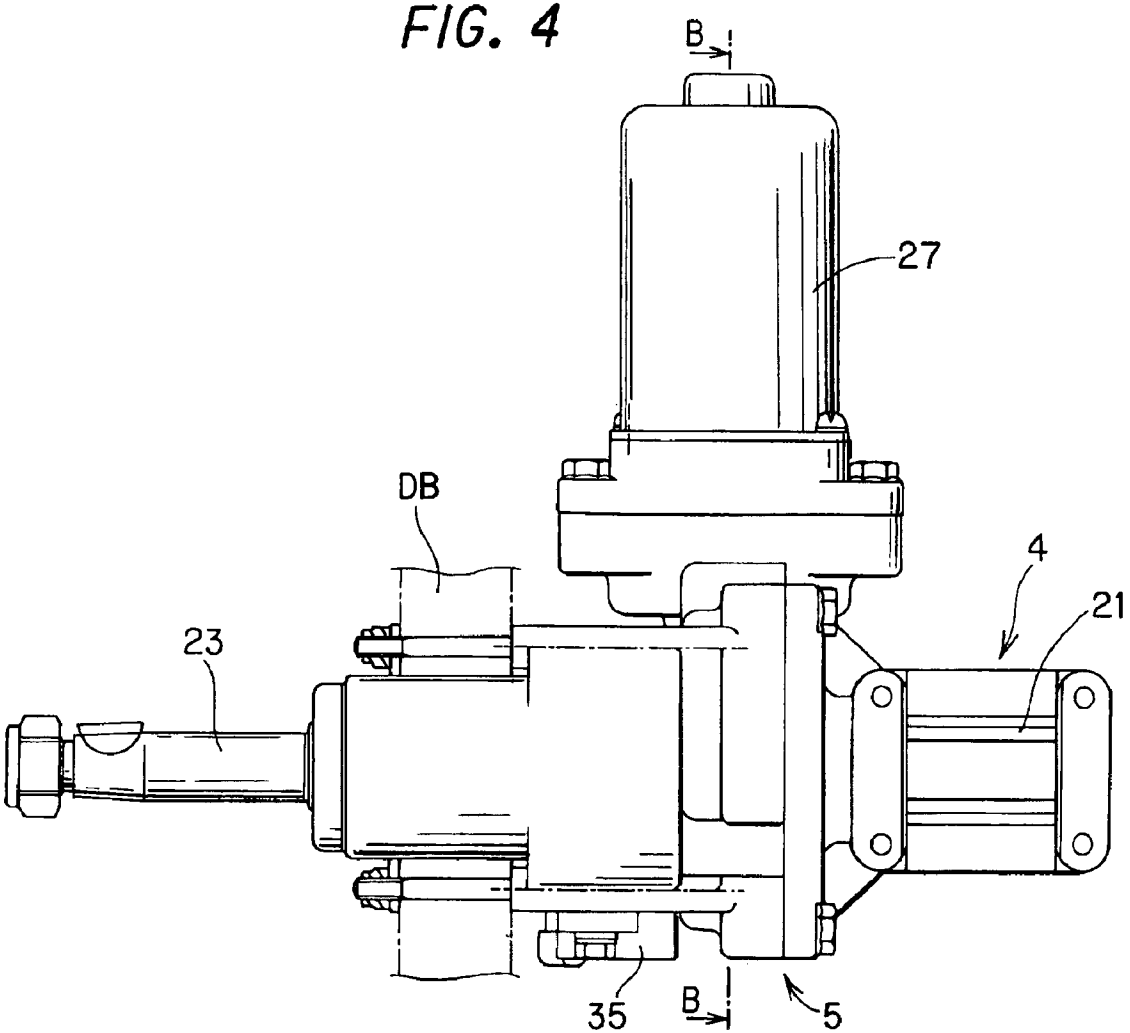
FIG. 4 is a plan view of a gear device and a power assist device of the power steering device.
Figure 5:
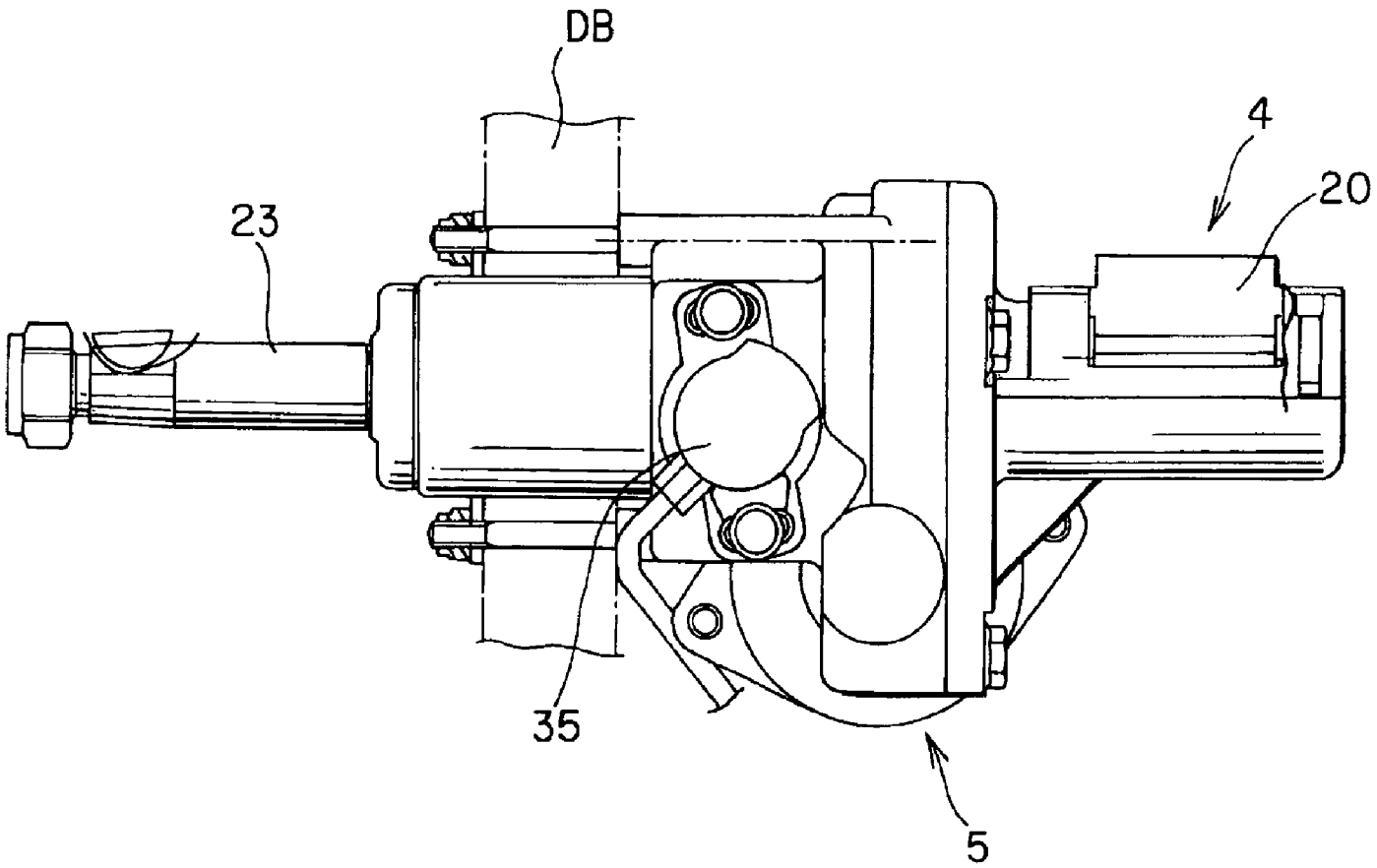
FIG. 5 is a side view of the gear device and the power assist device of the power steering device.
Figure 6:
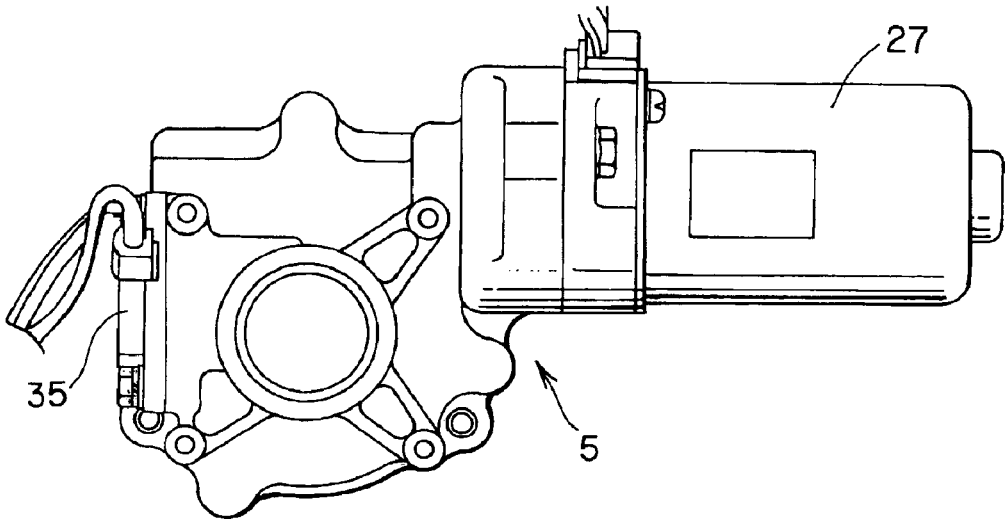
FIG. 6 is a side view of the gear device and the power assist device of the power steering device as seen from the steering wheel side.
Figure 7:
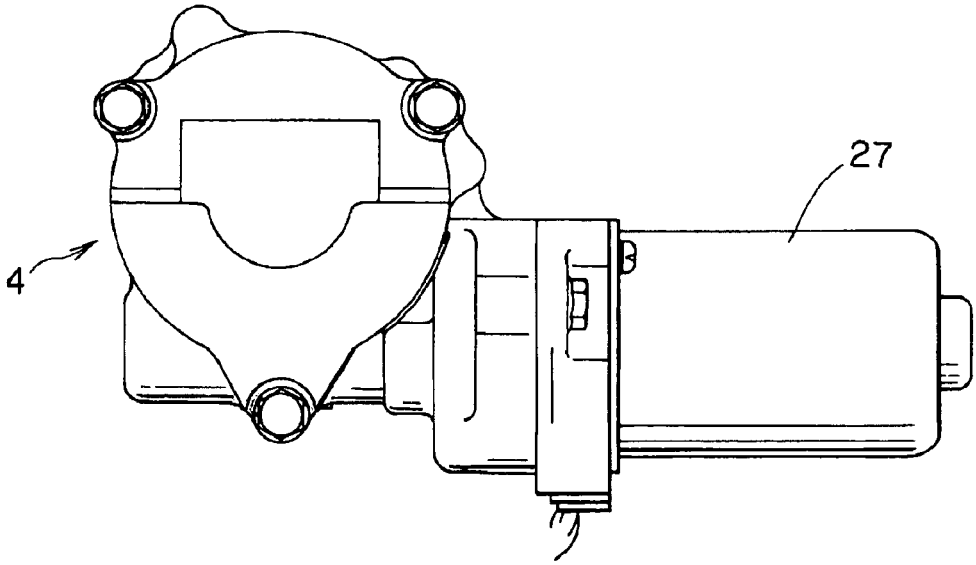
FIG. 7 is a side view of the gear device and the power assist device of the power steering device, showing the gear device side thereof.

As shown in FIG. 3, the link mechanism 7 transmits the push-pull action of the cable 3 through a drag link 17 to a steering bracket 16 fixed to the outboard motor main body 6A and extending toward the boat body 1 side, thereby the link mechanism 7 rotates the outboard motor 6. For this purpose, an end fitting 3B of an outer cable 3A of the cable 3 is fastened to the clamp bracket 15. A forward end rod 3C of an inner cable of the cable 3 protruding from the end fitting 3B of the outer cable 3A is connected to the drag link 17. In the example shown, the end fitting 3B of the outer cable 3A extends through both the clamp bracket 15 and the bracket 14 and is fixed to the clamp bracket 15 by means of a nut, thus also serving as a clamp bracket shaft 15A. Thus, through push-pull movement of the inner cable of the cable 3, the outboard motor main body 6A is rotated in a horizontal plane by the pilot shaft 14A through the drag link 17 and the steering bracket 16, whereby steering is effected. The drag link 17 and the steering bracket 16 constitute the link mechanism 7.

Figure 8:
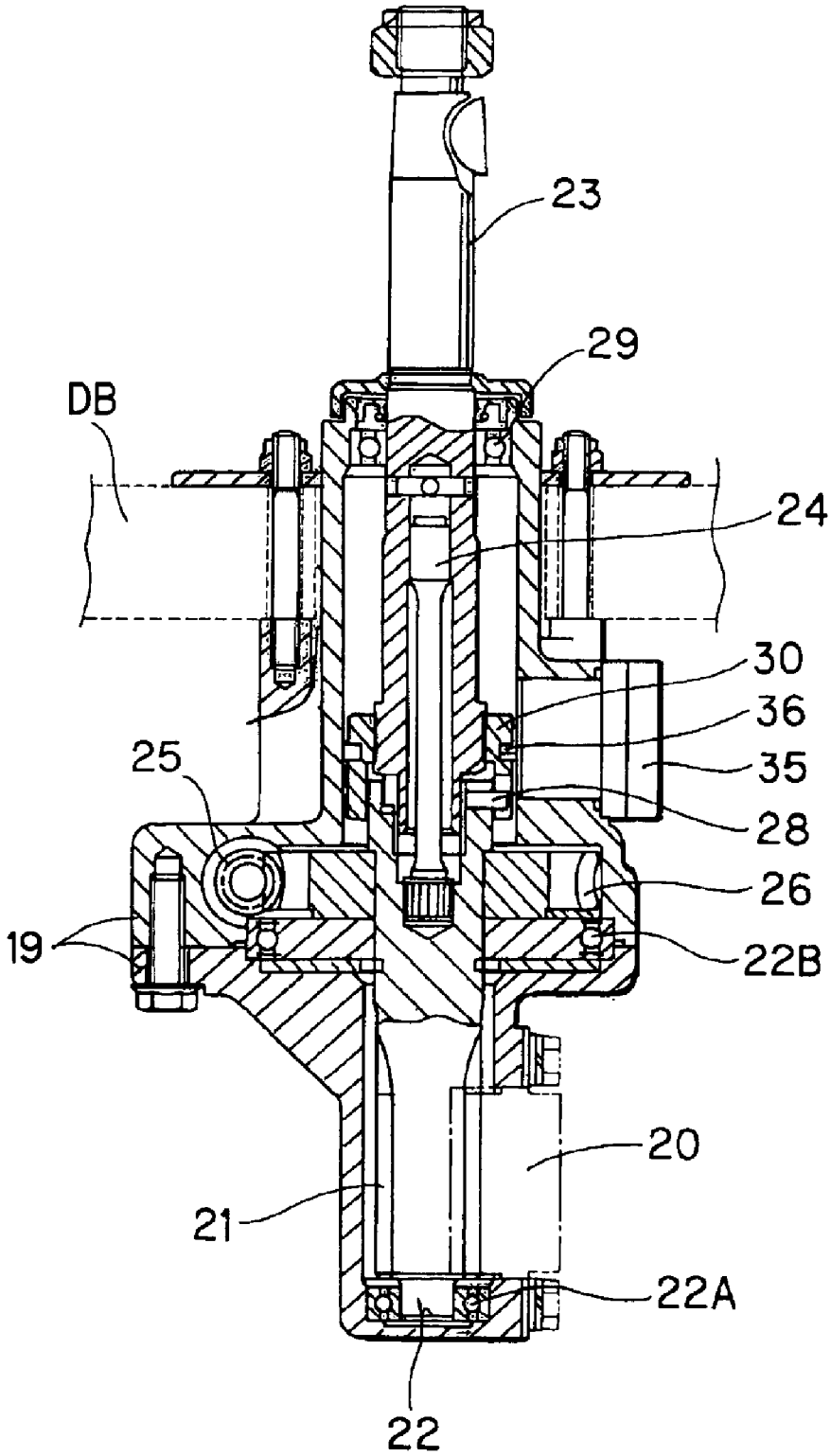
FIG. 8 is a sectional view of the gear device and the power assist device of the power steering device.

As shown in FIGS. 4 through 10, in particular, in FIG. 8, the gear device 4 is formed by a rack and pinion. Through its movement, a rack gear 20 pushes and pulls the inner wire of the cable 3. A pinion gear 21 is provided integrally with an output shaft 22. The output shaft 22 is connected, through the intermediation of a torsion bar 24, to a steering shaft 23 connected to the steering wheel 2. Further, the output shaft 22 is constructed such that a driving force from an electric motor 27 as an assist motor is applied thereto through a helical pinion 25 and a helical wheel 26. That is, the output shaft 22 is rotatably supported in a gear case 19 by means of a forward end side bearing 22A and a large diameter bearing 22B, which constitute both ends of the pinion gear 21. The helical wheel 26 is adjacent to the large diameter bearing 22B and fixed integrally thereto. On the rear end (steering wheel 2) side, the forward end portion of the steering shaft 23 is rotatably supported, and the forward end portion of the torsion bar 24 is fixed to the steering shaft 23 by serration or the like. Further, at the rear end of the output shaft 22, a torque pin 28 protrudes outwardly. The gear case 19 is fastened to a dashboard DB at the driver's seat by means of screws.

The steering shaft 23 is rotatably supported in the gear case 27 also by a bearing 29, and the rear end portion thereof is connected to the steering wheel 2. The steering shaft 23 has a hollow, which contains the torsion bar 24 whose rear end portion is fixed by a pin. A torque ring 30 is attached to the outer periphery of the steering shaft 23 so as to be integrally rotated by spline or serration and axially movable.

Figure 9:
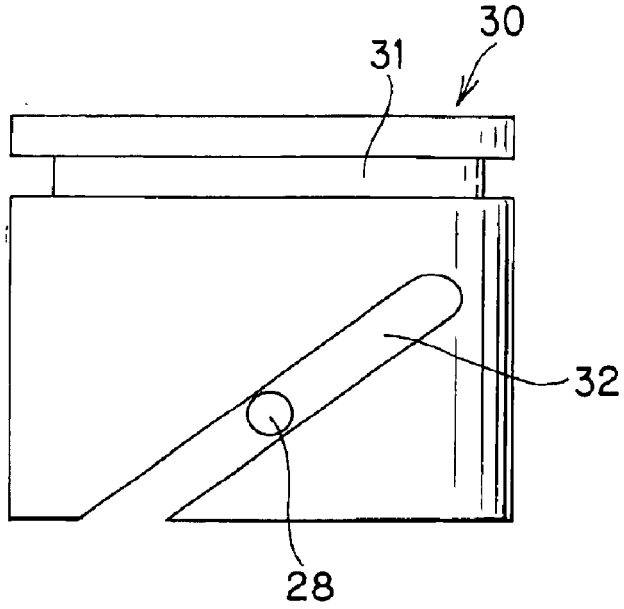
FIG. 9 is an enlarged view of a torque ring of the power steering device.

As shown in FIG. 9, the torque ring 30 is equipped with a circumferential groove 31 provided in the outer periphery and an oblique groove 32 inclined with respect to the axial direction and engaged with the torque pin 28 of the output shaft 22. Fitted into the circumferential groove 31 is a detection pin 36 of a position detecting device serving as a torque sensor 35. Thus, when the steering torque generated by operating the steering wheel 2 is transmitted from the steering shaft 23 to the output shaft 22 through the torsion bar 24, the torque ring 30 converts, according to the amount of torsion generated in the torsion bar 24, the relative rotating amount of the output shaft 22 and the steering shaft 23 into an axial movement of the torque ring 30 through engagement of the torque pin 28 and the oblique groove 32. This axial movement causes the detection pin 36 engaged with the circumferential groove 31 to move in the axial direction, and is sensed by the torque sensor 35 as a steering torque.

Figure 10:
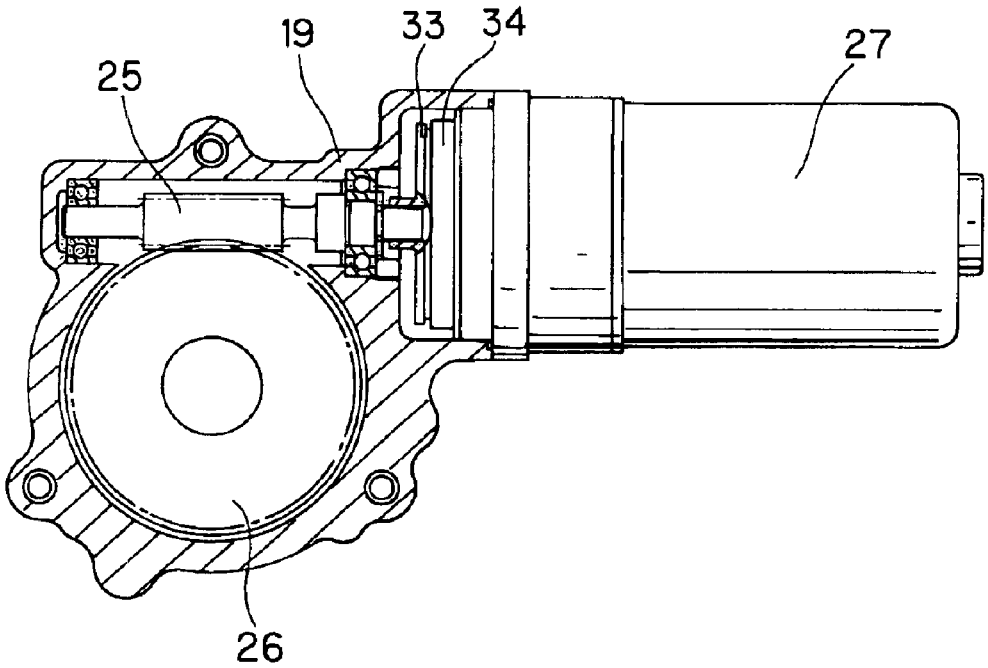
FIG. 10 is a sectional view of the power assist device of the power steering device.

The helical wheel 26 is engaged with the helical pinion 25. As shown in FIG. 10, the helical pinion 25 is rotatably supported in the gear case 19. A clutch plate 33 is connected to one end of the helical pinion 25 so as to be axially movable and capable of integral rotation. The clutch plate 33 can be brought into contact with and separated from a drive plate 34 rotated by the assist motor 27. When a clutch coil (not shown) is energized, the two plates 33 and 34 are brought into contact with each other, making it possible to transmit the driving force of the assist motor 27 to the helical pinion 25. When the energization of the clutch coil is canceled, the two plates 33 and 34 are separated from each other, and the helical pinion 25 and the helical wheel 26 are detached from the assist motor 27 to be rotated by the output shaft 22. The assist motor 27 (electric motor), the helical pinion 25, and the helical wheel 26 constitute the power assist device 5.

Figure 11:
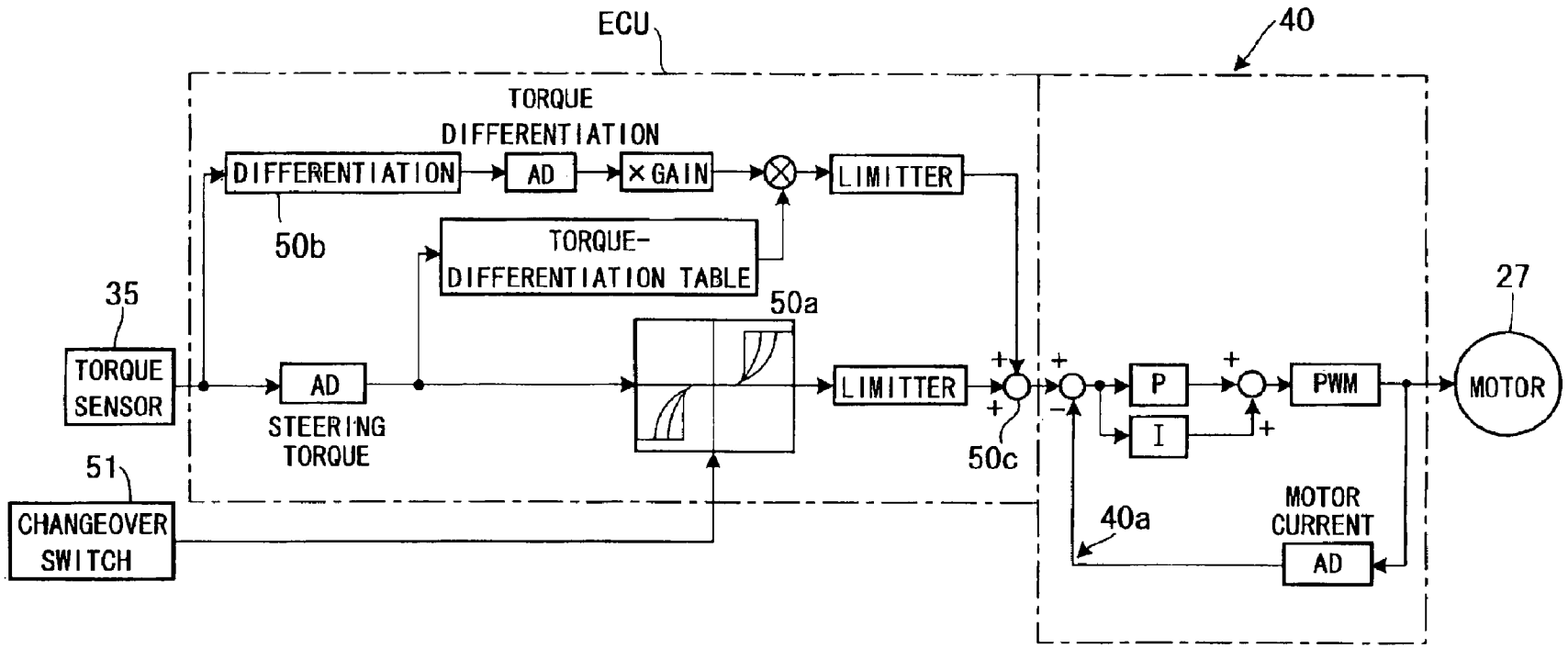
FIG. 11 is a block diagram showing an electric motor control system.

FIG. 11 is a block diagram showing a controller for controlling the electric motor. The block diagram is composed of a portion illustrating the processing executed in the ECU and a portion illustrating the processing executed by the drive circuit 40 of the electric motor 27. In the following, the processing executed in the ECU will be described in detail. The processing to be executed in the ECU is mainly conducted by principal assist current determination processing means 50*a*, auxiliary assist current determination processing means 50*b*, and auxiliary assist current addition processing means 50*c*.

Figure 12:
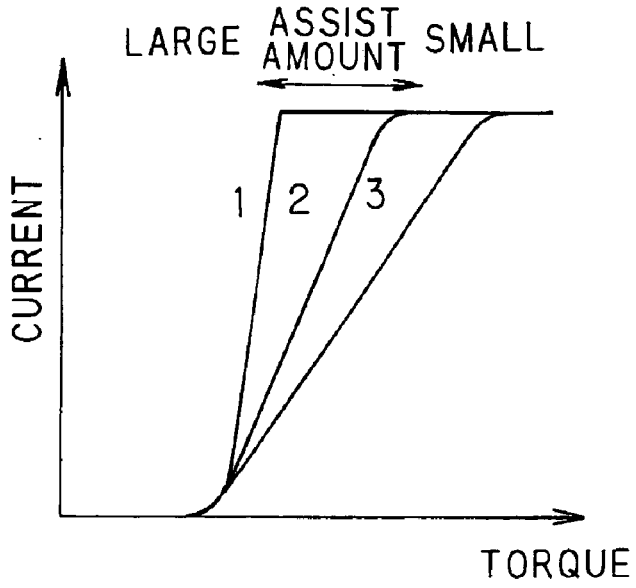
FIG. 12 is a characteristic diagram showing assist characteristics due to principal assist current value.

The principal assist current determination processing means 50*a* determines a first principal assist current value according to the value of the output signal of the torque sensor 35, that is, the magnitude of the steering torque imparted by the steersman. This principal assist current determination processing means 50*a* picks up, from among data previously stored in the controller, data regarding the assist current value corresponding to the magnitude of the steering torque (the output signal value of the torque sensor 35), and determines the data as the first principal assist current value. As shown in FIG. 12, this first principal assist current value is proportional to approximately the square of the output signal value of the torque sensor 35. Further, an increase or decrease in the assist amount is effected by changing the assist amount by a switch 51 provided in the vicinity of the steering wheel 2, increasing or decreasing the magnitude of the steering torque as indicated at 1 through 3 in the drawing. When increasing the assist amount, the increase in the drive current is enhanced in conformity with the increase in the steering torque, and when decreasing the assist amount, the increase in the drive current is restrained in conformity with the increase in the steering torque.

The auxiliary assist current determination processing means 50*b* performs the operation of differentiating the output signal of the torque sensor 35. The auxiliary assist current addition processing means 50*c* performs the operation of adding the value of the output signal of the torque sensor 35 differentiated by the auxiliary assist current determination processing means 50*b* (differential value of the output signal of the torque sensor 35) to the principal assist current value. The second principal assist current value after the addition of the differential value of the output signal of the torque sensor 35 constitutes the value of the electric current flowing through the electric motor 27 (assist current value). The differential value of the output signal of the torque sensor 35 is thus added to the first principal assist current value for the following two reasons.

The first reason is to shorten the time (hereinafter referred to as the "delay time") it takes for the assist force to be transmitted to the helical wheel 26 through the helical pinion 25 after the detection of the steering torque by the torque sensor 35. That is, it is done for the purpose of achieving an improvement in assist responsiveness. Thus, even in the case in which the steering torque detected by the torque sensor 35 undergoes an abrupt change, it is possible to assist the steering force with an assist force in conformity with that steering torque which has undergone an abrupt change.

The second reason is to prevent oscillation of the first principal assist current value. Such oscillation occurs when the gain 1 (0 dB) and the phase is reversed by 180 degrees. Thus, the phase is advanced by 90 degrees through differentiation to thereby prevent oscillation.

The drive circuit 40 drives the electric motor 27 in accordance with the second principal assist current value. The drive circuit 40 is equipped with a feedback processing 40*a* for maintaining the value of the electric current flowing through the electric motor 27 at a fixed level, and for feeding back the value of the electric current flowing through the electric motor 27 to the assist current value.

The steering by the power steering device for a boat with an outboard motor of the present invention will be briefly described.

1. The steering wheel 2 is steered, for example, to the right (or left) from the neutral state.

2. The steering shaft 23 and the torque ring 30 are rotated to the right (or left) by the steering.

3. By the rotation of the steering shaft 23 and the torque ring 30 to the right (left), the output shaft 22 is turned to the right (or left) through the torsion bar 24.

4. By the rotation to the right (or left) of the output shaft 22, the inner cable of the cable 3 is pushed out of the end fitting 3B (or drawn into the end fitting) through the rack and pinion 20 and 21.

5. When the inner cable is pushed out of the end fitting 3B (or drawn into the end fitting), the steering bracket 16 and the outboard motor 6 are rotated counterclockwise (or clockwise) in a horizontal plane through the drag link 17.

6. Due to the counterclockwise (or clockwise) rotation of the outboard motor 6, a rightward (or leftward) moment is applied to the boat body 1, causing the boat body 1 to advance while turning to the right (or to the left).

In the above steering, the torsion bar 24 is twisted in accordance with the steering force, and this twisting changes the axial position of the torque ring 30 in accordance with the twisting direction of the torsion bar 24. This change causes the detection pin 36 to move and the movement of the detection pin 36 is detected by the torque sensor 35 as the steering torque. The steering torque detected is input to the ECU, and as stated above, the principal assist current is determined, the auxiliary assist current determination means 50*b* and the auxiliary assist current determination means 50*c* executing their respective processings. Upon the processings, the electric motor 27 is driven by the drive circuit 40, and the processing of the feedback processing means 40*a* is executed, assisting the steering operation of the steering wheel 2.

Thus, according to the first aspect of this invention, there is provided the gear device driven by the steering wheel through the push-pull cable (=connection mechanism), and the steering torque input to the gear device by the steering wheel is detected by the torque sensor (=torque detecting device) to assist-drive the gear device in the steering direction by the electric motor (=gear drive device). Thus, the gear drive device and the torque detecting device can be arranged so as to be annexed to the steering shaft directly operated with the steering wheel and to the gear device, so that there is no need to worry about intrusion of water scattered from the propeller of the outboard motor, etc., which means there is no need for enhancement in waterproofness which would lead to an increase in production cost, thus making it possible to provide an inexpensive power steering device. Further, the output value of the torque detecting device does not include wire friction, and it is possible to directly detect the human force for operating the steering wheel, thereby making it possible to detect the steering torque with high accuracy. Thus, it is possible to reduce the requisite steering force by enhancing the assisting force of the electric motor driven based on computation at the ECU. Further, it is possible to provide a satisfactory steering feel since no friction component is included.

And the gear device, the torque detecting device , and the gear drive device are integrally connected and assembled. Thus, it is possible to achieve a further reduction in cost, and the handling of the device is facilitated.

And the gear drive device is connected to the gear device through a clutch device. According to the invention, due to the clutch portion, the electric motor can be separated and made free. Thus, when the device, the power source, etc. are out of order, the clutch is disengaged to thereby make it possible to manually steer the outboard motor by operating the gear device, the connection mechanism, and the link mechanism by the steering wheel, with the gear drive device constituting no load.

Figure 13:
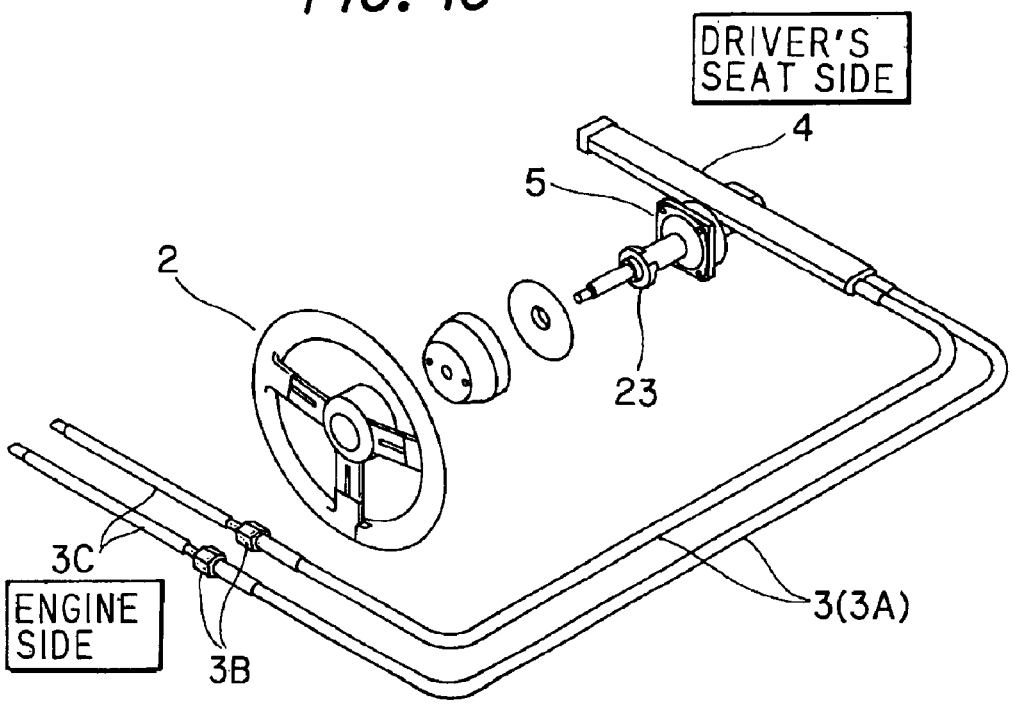
FIG. 13 is a perspective view of another embodiment of a cable 3 of the power steering device for a boat.

FIG. 13 shows a second embodiment of the power steering device for a boat with an outboard motor. While in the first embodiment the link mechanism 7 is operated by using a single cable 3, in the second embodiment, the link mechanism 7 is operated by using two cables 3. The forward ends 3C of the two cables 3 are both connected to the drag link 17. The end fitting 3B of one cable 3 also serves as the clamp bracket shaft 15A, whereas, although fixed to the clamp bracket 15, the end fitting 3B of the other cable 3 does not also serve as the shaft 15A. By thus using two cables 3, it is possible to increase the operating force transmitted, and to transmit the operating force power-assisted by the electric motor to the link mechanism in an optimum manner.

Figure 14:
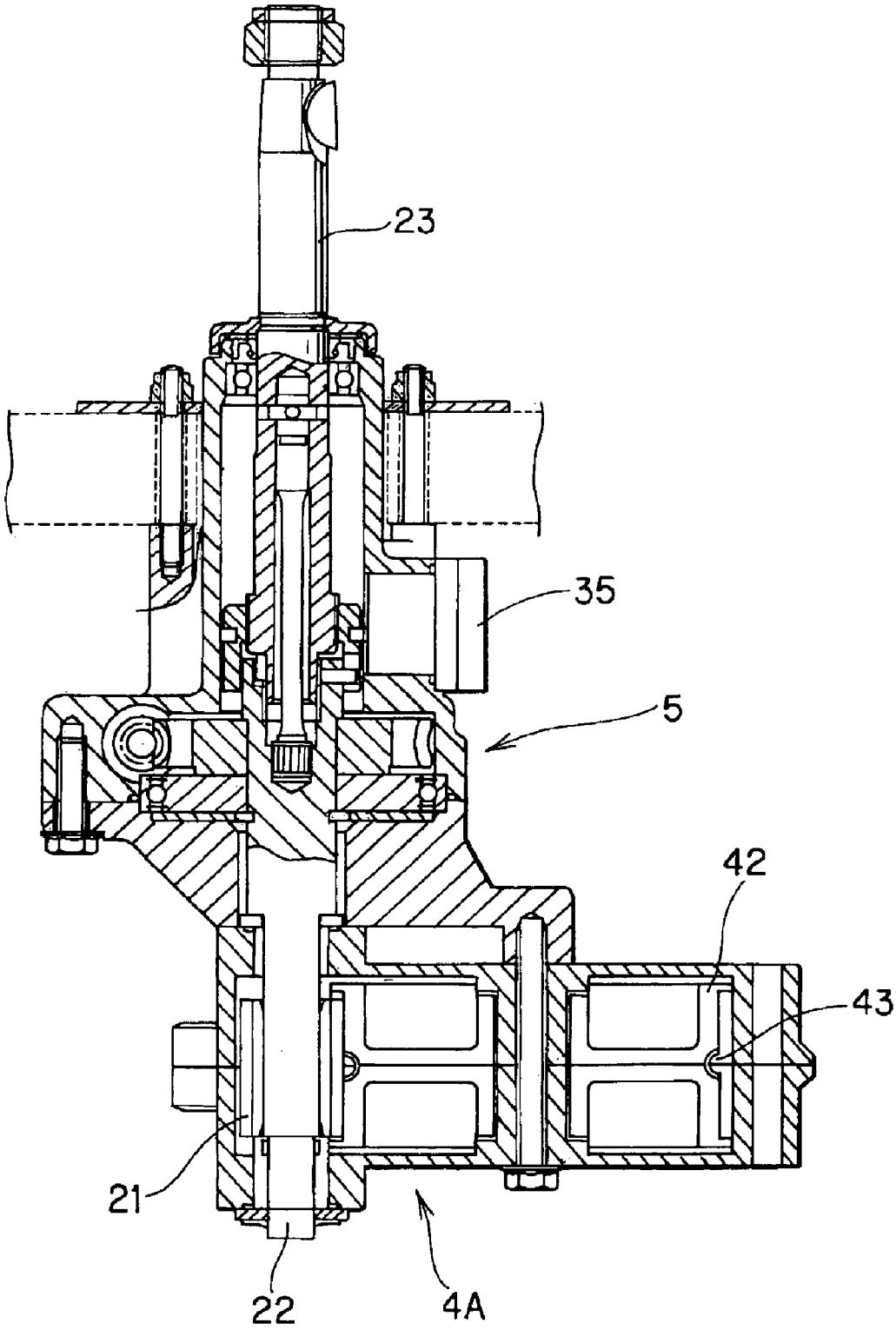
FIG. 14 is a sectional view of still another embodiment of the power steering device for a boat.
Figure 15:
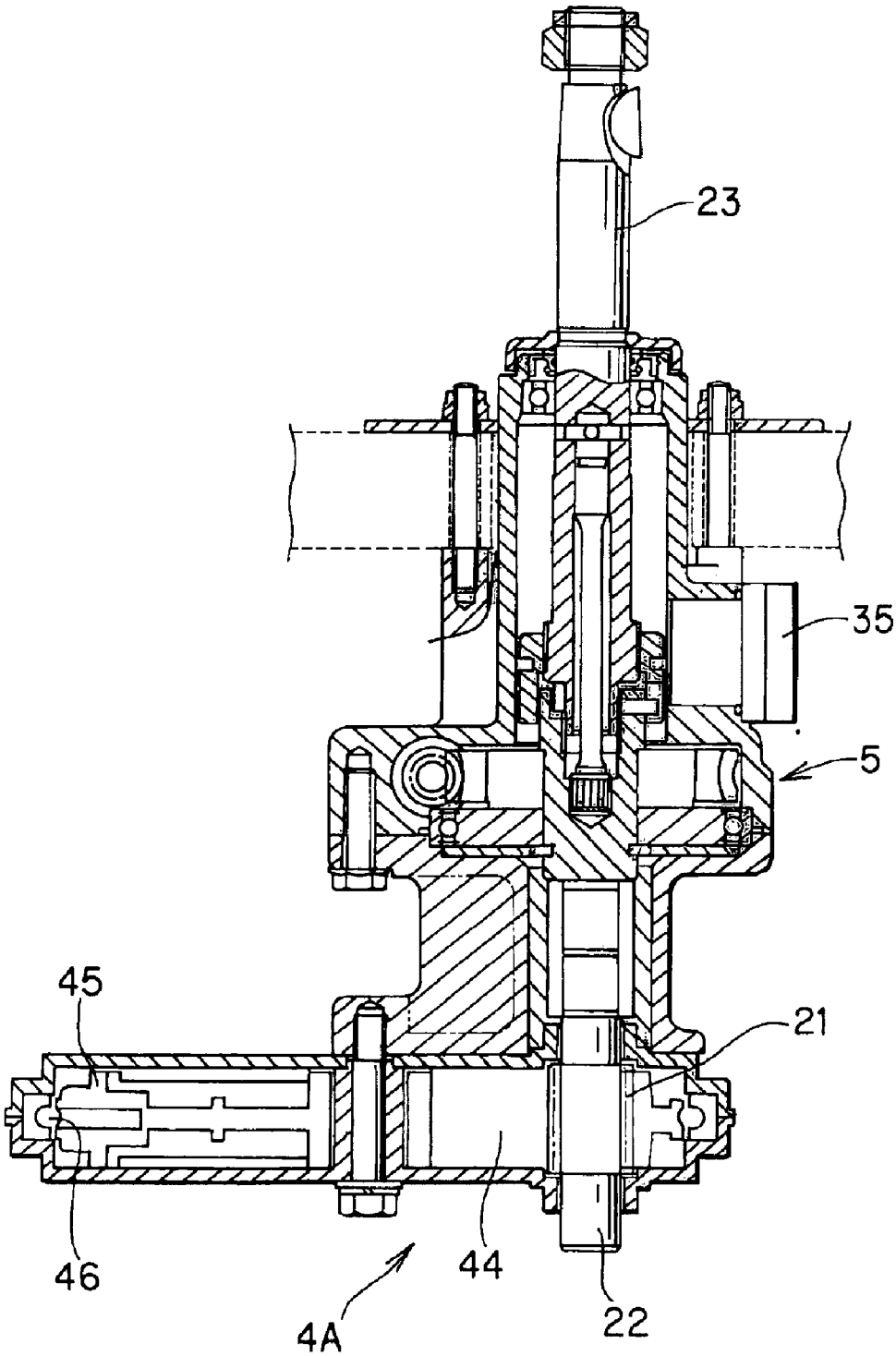
FIG. 15 is a sectional view of yet another embodiment of the power steering device for a boat.

FIG. 14 and FIG. 15 show a third embodiment of the power steering device for a boat with an outboard motor. While in the first embodiment a rack and pinion are used as the gear device 4, a round gear device 4A is used in this embodiment. That is, in FIG. 14, there is used a drum-shaped gear 42 in mesh with the pinion 21 of the output shaft 22, and the drum-shaped gear 42 is equipped with a groove 43 around which a wire is wound. Through the wire wound around this groove 43, the drag link 17 of the link mechanism 7 is caused to perform a push-pull action. In FIG. 15, there is used a drum-shaped inscribed gear 44 in mesh with the pinion 21 of the output shaft 22, and, in the outer periphery of a drum 45, there is provided a groove 46 around which a wire is wound. Through this wire wound around the groove 46, the drag link 17 of the link mechanism 7 is caused to perform a push-pull action. In this case, the inscribed gear 44 is not provided over the entire periphery of the drum 45 but partially in a sector form.

What is claimed is:

1. A power steering device for a boat equipped with an outboard motor arranged at a rear of a boat body so as to be horizontally swingable, comprising:

a link mechanism for swinging an outboard motor main body at the rear of the boat body;

a gear device operated by a steering wheel;

a connection mechanism for transmitting an output of the gear device to the link mechanism;

a torque detecting device for detecting a steering torque input to the gear device from the steering wheel;

a gear drive device for assist-driving the gear device in a steering direction according to at least a detection signal of the torque detecting device; and a control device adapted to take in the detection signal of the torque sensor and to perform computation on the detection signal to drive the gear drive device, and wherein, the control device controls the gear drive device based on a second assist value which comprises a sum of a differential value of the output signal of the torque detecting device and a first principal assist current value which is provided based on the detection signal of the torque detecting device.

2. A power steering device for a boat according to claim 1, wherein the gear device, the torque detecting device, and the gear drive device are integrally connected and assembled.

3. A power steering device for a boat according to claim 1, wherein the gear drive device is connected to the gear device through a clutch device.

* * * * *